US010219055B2

(12) United States Patent
Li et al.

(10) Patent No.: US 10,219,055 B2
(45) Date of Patent: Feb. 26, 2019

(54) LOUDSPEAKER MODULE

(71) Applicant: GOERTEK INC., WeiFang (CN)

(72) Inventors: Zhaopeng Li, WeiFang (CN); Huawei Liu, WeiFang (CN); Xueping Song, WeiFang (CN); Zhilei Han, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 15/571,494

(22) PCT Filed: Nov. 18, 2015

(86) PCT No.: PCT/CN2015/094898
§ 371 (c)(1),
(2) Date: Nov. 2, 2017

(87) PCT Pub. No.: WO2016/176981
PCT Pub. Date: Nov. 10, 2016

(65) Prior Publication Data

US 2018/0139522 A1 May 17, 2018

(30) Foreign Application Priority Data

May 6, 2015 (CN) ..... 2015 1 0227071

(51) Int. Cl.
*H04R 1/02* (2006.01)
*H04R 31/00* (2006.01)

(52) U.S. Cl.
CPC ..... *H04R 1/02* (2013.01); *H04R 1/023* (2013.01); *H04R 1/025* (2013.01); *H04R 31/00* (2013.01)

(58) Field of Classification Search
CPC . H04R 1/28; H04R 1/02; H04R 1/025; H04R 1/026; H04R 2209/022; H04R 2225/49
(Continued)

(56) References Cited

U.S. PATENT DOCUMENTS 4,063,049 A * 12/1977 Pipitone ..... H04R 7/22 381/173

FOREIGN PATENT DOCUMENTS

CN 103354629 A 10/2013
CN 203618117 U 5/2014
(Continued)

OTHER PUBLICATIONS

International Search Report for International Patent Application No. PCT/CN2015/094898, filed on Nov. 18, 2015.
(Continued)

*Primary Examiner* — Suhan Ni

(57) ABSTRACT

Disclosed is a loudspeaker module comprising a module housing, wherein a loudspeaker unit is accommodated in the module housing; the loudspeaker unit comprises a unit housing and a unit front cover; an end surface of a sidewall of at least one side of the unit housing is provided with an ultrasonic surface welded to the module housing by means of ultrasound; and an ultrasonic line bonded with the ultrasonic surface by means of ultrasound is provided at a position on the module housing corresponding to the ultrasonic surface. The loudspeaker module of the present invention solves the technical problems of a complex assembly process, poor sealing performance and poor appearance of the loudspeaker module in the prior art, and the loudspeaker module of the present invention has a simple assembly process, good sealing performance, high quality appearance, excellent acoustic performance, high production efficiency and low production cost.

9 Claims, 3 Drawing Sheets

(58) Field of Classification Search
USPC ..... 381/345, 386, 388, 189
See application file for complete search history.

(56) References Cited

FOREIGN PATENT DOCUMENTS

| | | | |
|---|---|---|---|
| CN | 203747988 | U | 7/2014 |
| CN | 204231647 | U | 3/2015 |
| CN | 104540076 | A | 4/2015 |
| CN | 204291291 | U | 4/2015 |
| CN | 204291379 | U | 4/2015 |
| CN | 104796817 | A | 7/2015 |
| CN | 204598283 | U | 8/2015 |
| JP | 2011-160182 | A | 8/2011 |

OTHER PUBLICATIONS

Office Action for Chinese Patent Application No. 201510227071.X, dated Jan. 11, 2018.

* cited by examiner

LOUDSPEAKER MODULE

CROSS-REFERENCE TO RELATED APPLICATIONS

The present specification is a U.S. National Stage of International Patent Application No. PCT/CN2015/094898 filed Nov. 18, 2015, which claims priority to and the benefit of Chinese Patent Application No. 201510227071.X filed in the Chinese Intellectual Property Office on May. 6, 2015, the entire contents of which are incorporated herein by reference.

TECHNICAL FIELD

The present invention relates to the technical field of electro-acoustic products, specifically, to a loudspeaker module.

BACKGROUND ART

The loudspeaker module is an important acoustical component of the portable electronic device, is used for transforming electrical signal and acoustical signal, and is an energy converter. The existing loudspeaker module typically comprises a module housing in which a loudspeaker unit is accommodated, and the inner cavity of the entire module is divided into a front acoustic cavity and a rear acoustic cavity by the loudspeaker unit. The existing loudspeaker unit is typically positioned by a positioning structure provided on the module housing, and then fixed on the module housing by gluing. Such a module with a positioning structure provided on the module housing for fixing the loudspeaker unit has the following drawbacks: the structure of the module housing is very complex, the processing of the module housing is difficult, and the positioning structure will occupy the space of the inner cavity of the module, which will seriously affect the acoustic performance of the module. At the same time, the gluing process is complex, the fixation is not firm and the sealant is prone to cracking, which seriously reduces the service life of the module.

As the current portable electronic devices are becoming lighter and thinner, the structure of the loudspeaker module is required to be adapted to the change in the internal space of electronic equipments. In order to ensure the acoustic performance of the module, that is, to ensure that the space in the inner cavity of the module is large enough, the structures of the loudspeaker modules are mostly irregular structures, and some of the loudspeaker units within the modules will be infinitely close to the edge of the module housing, and even parts of some loudspeaker units will be exposed to the outside of the module housing. The inner cavity of such a loudspeaker module with exposed parts of loudspeaker units is more difficult to be sealed. At present, the commonly used solution is to apply a great quantity of sealant between the loudspeaker unit and the module housing. However, this kind of sealing method not only has difficult assembly process, high complexity, and high production cost, but also has poor airtightness, low quality of appearance and low product yield.

SUMMARY

In view of the above drawbacks, a technical problem sought to be solved by the present invention is to provide a loudspeaker module, the loudspeaker module comprises a module housing with a simple structure, and has stronger bonding strength between the loudspeaker unit and the module housing, simple assembly process, good acoustic performance and long service life.

Furthermore, a technical problem sought to be solved by the present invention is to provide a loudspeaker module with parts of the loudspeaker unit exposed to the outside, the loudspeaker module comprises a module housing with a simple structure, and has stronger bonding strength between the loudspeaker unit and the module housing, simple assembly process, good acoustic performance and long service life. At the same time, the loudspeaker module has good sealing property, good appearance quality, and high product yield.

In order to solve the above technical problems, the technical solution of the present invention is:

a loudspeaker module, comprising a module housing, wherein a loudspeaker unit is accommodated in the module housing, the loudspeaker unit comprises a unit housing and a unit front cover combined with each other, and a vibration system and a magnetic circuit system are accommodated in a space defined by the unit housing and the unit front cover; an end surface of at least one sidewall of the unit housing is provided with an ultrasonic surface ultrasonic welding with the module housing, and the module housing is provided with an ultrasonic line which is provided at a position corresponding to the ultrasonic surface and is combined with the ultrasonic surface by ultrasonic welding.

Wherein the loudspeaker unit is disposed adjacent to an edge of one side of the module housing, a sidewall of the unit housing is exposed to the outside of the module housing, and the ultrasonic surface is provided on the sidewall of the unit housing exposed to the outside of the module housing.

Wherein another sidewall of the unit housing, which is disposed corresponding to the sidewall exposed to the outside of the module housing, is also provided with the ultrasonic surface.

Wherein the ultrasonic surface is lower than a corresponding end surface of the magnetic circuit system, the module housing is provided with a blocking wall which is provided at a position corresponding to the ultrasonic surface and extends towards the ultrasonic surface, and the ultrasonic line is provided on an end surface of the blocking wall.

Wherein the middle portion of the ultrasonic surface is a flat surface, and both ends of the ultrasonic surface are inclined surfaces extending towards an upper end surface of the unit housing and extending to the upper end surface, and the structure of the end surface of the blocking wall is adapted to the structure of the ultrasonic surface.

Wherein the end surface of the sidewall of the unit housing provided with the ultrasonic surface is a stepped end surface comprising a first stepped surface located at the inner side and a second stepped surface located at the outer side, a position of the first stepped surface is higher than a position of the second stepped surface, the first stepped surface is the ultrasonic surface; and the end surface of the blocking wall has a stepped structure adapted to the stepped end surface, and the ultrasonic line is provided on a stepped surface of the stepped structure corresponding to the first stepped surface.

Wherein the module housing comprises an upper housing and a lower housing combined with each other, the sidewall of the unit housing exposed to the outside of the module housing is located between the upper housing and the lower housing, and the blocking wall is provided on the lower housing.

Wherein the upper housing is provided with a first mounting hole at a position corresponding to the loudspeaker unit, the unit front cover is located at the first mounting hole, and an outer surface of the unit front cover is flush with an outer surface of the upper housing; a retaining wall surrounding an outer side of the first mounting hole is provided at an inner side of the upper housing, and an inner surface of the upper housing is formed with a gluing band between the retaining wall and an edge of the first mounting hole.

Wherein the lower housing is provided with a second mounting hole at a position corresponding to the loudspeaker unit, a lower end of the magnetic circuit system is located at the second mounting hole, a lower end surface of the magnetic circuit system is flush with an outer surface of the lower housing; and the outer surface of the lower housing is provided with a chamfering slope located at a periphery of the second mounting hole, the lower end surface of the magnetic circuit system is provided with a recessed edge portion, and a glue accommodating groove is formed between the chamfering slope and the edge portion.

Wherein the magnetic circuit system comprises a yoke, and an inner magnet and an inner washer fixed to the middle portion of an inner side of the yoke successively, edge magnets and edge washers are successively fixed to edge portions of two sides of the yoke parallel to the ultrasonic surface, inner sides of two sidewalls of the unit housing, which are located at the same sides as two said edge washers, are provided with positioning protrusions which are provided at positions corresponding to the edge washers and extend towards the edge washers, and the edge washers are provided with positioning recesses which are provided at positions corresponding to the positioning protrusions and are adapted to the positioning protrusions.

According to the technical solutions of the present invention, the advantageous effects of the present invention are described below.

As the loudspeaker module of the present invention comprises a module housing, wherein a loudspeaker unit is accommodated in the module housing; the loudspeaker unit comprises a unit housing and a unit front cover combined with each other; the lower end surface of at least one sidewall of the unit housing is provided with an ultrasonic surface; and the module housing is provided with an ultrasonic line which is provided at a position corresponding to the ultrasonic surface and is bonded to the ultrasonic surface by ultrasonic welding. The ultrasonic welding process is simple, has strong bonding strength, so that the loudspeaker unit will not fall apart from the housing due to cracked sealant, and has long service life. At the same time, the module housing does not require to provide complex positioning structure, which simplifies the structure of the module housing, reduces the processing difficulty of the module housing, effectively saves the internal space of the module, greatly improves the acoustic performance of the loudspeaker module, and reduces production costs.

As a sidewall of the unit housing is exposed to the outside of the module housing, and the ultrasonic surface is provided on the sidewall of the unit housing exposed to the outside of the module housing, this feature enables the combination of the exposed sidewall of the unit housing and the module housing through an ultrasonic welding process. Compared with the existing gluing seal, this combination method has a simpler assembly process, and good sealing performance, and would not leak. At the same time, the appearance quality of the module is high, the external dimension of the module does not change, and the production efficiency is high and the product yield is high.

As the ultrasonic surface is also provided on another sidewall of the unit housing, which is opposite to the sidewall exposed to the outside of the module housing, that is, two sidewalls of the unit housing, which are opposite to each other, are combined with the module housing by ultrasonic welding. During the ultrasonic welding, the loudspeaker unit is stressed uniformly, which is effective to avoid phenomena, such as, bended or distorted vibrating diaphragm due to uneven stress applied to the loudspeaker unit during ultrasonic welding, and cracked sealant in the front cavity, thereby further improving the acoustic performance and finished product yield of the loudspeaker module.

As the middle portion of the ultrasonic surface is a flat surface, and both ends of the ultrasonic surface are inclined surfaces extending towards the upper end surface of the unit housing and extending to the upper end surface, and the structure of the end surface of the blocking wall is adapted to the structure of the ultrasonic surface, this structure of the ultrasonic surface ensures that side surfaces of the sidewall of the unit housing, other than the upper end surface of the sidewall, can be combined with the module housing by ultrasonic welding, thereby further improving the airtightness of the module and simplifying the assembly process.

As the end surface of the sidewall of the unit housing provided with the ultrasonic surface is a stepped end surface comprising a first stepped surface located at the inner side and a second stepped surface located at the outer side, the position of the first stepped surface is higher than the position of the second stepped surface, the first stepped surface is the ultrasonic surface; and the end surface of the blocking wall has the stepped structure adapted to the stepped end surface, and the ultrasonic line is provided on the stepped surface of the stepped structure corresponding to the first stepped surface. The end surfaces of the unit housing and the blocking wall which are combined with each other are arranged as stepped structures, and the two stepped structures cooperate with each other during ultrasonic welding, which greatly improves the positioning accuracy of the loudspeaker unit, and the accuracy of the ultrasonic welding position, thereby further improving the sealing property of the module.

In view of the above, the loudspeaker module of the present invention solves the technical problems of a complex assembly process, a poor sealing performance and a poor appearance of the loudspeaker module in the prior art, and the loudspeaker module of the present invention has a simple assembly process, a good sealing performance, a high quality appearance, an excellent acoustic performance, a high production efficiency and a low production cost.

Figure 1:
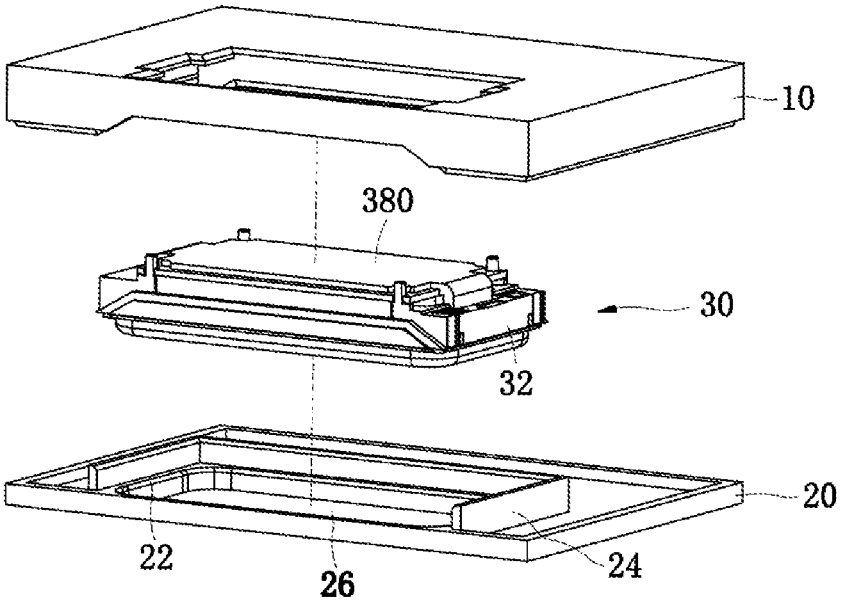
FIG. 1 is a schematic view of the breakdown structure of a loudspeaker module of the present invention.

In the drawings: 10, lower housing; 12, chamfering slope; 140, ultrasonic line; 142, boss; 144, ultrasonic line; 16, second mounting hole; 18, blocking wall; 20, upper housing; 22, gluing band; 24, retaining wall; 26, first mounting hole;

30, loudspeaker unit; 32, unit housing; 320, stepped end surface; 322, first stepped surface; 324, second stepped surface; 326, positioning protrusion; 34, unit front cover; 360, vibrating diaphragm; 362, dome; 364, voice coil; 380, yoke; 3800, edge portion; 382, inner magnet; 384, edge magnet; 386, inner washer; 388, edge washer; 3880, positioning recess; 40, glue accommodating groove.

DETAILED DESCRIPTION OF EMBODIMENTS

Hereinafter, the present invention will be described in details in connection with the accompanying drawings and the embodiments.

All the "upward" orientations related in this specification refer to the orientation of the vibration system of the loudspeaker unit, and all the "downward" orientations refer to the orientation of the magnetic circuit system of the loudspeaker unit. All the terms "inside" related in this specification refer to a side inside the inner cavity of the module or the inner cavity of the loudspeaker unit, and all the terms "outside" refer to a side outside the inner cavity of the module or the inner cavity of the loudspeaker unit.

Figure 2:
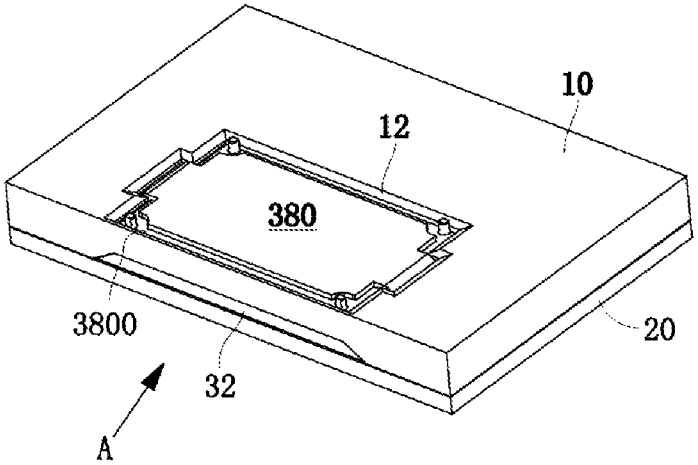
FIG. 2 is an assembly diagram of FIG. 1.

As shown in FIG. 1 and FIG. 2, a loudspeaker module, having a rectangular structure, comprises a housing which is composed of an upper housing 20 and a lower housing 10 combined with each other, and the loudspeaker unit 30 is accommodated in the space defined by the upper housing 20 and the lower housing 10. The loudspeaker unit 30 also has a rectangular structure, and the loudspeaker unit 30 is located at the edge of one side of the module. The entire inner cavity of the module is divided into a front acoustic cavity and a rear acoustic cavity by the loudspeaker unit 30.

Figure 4:
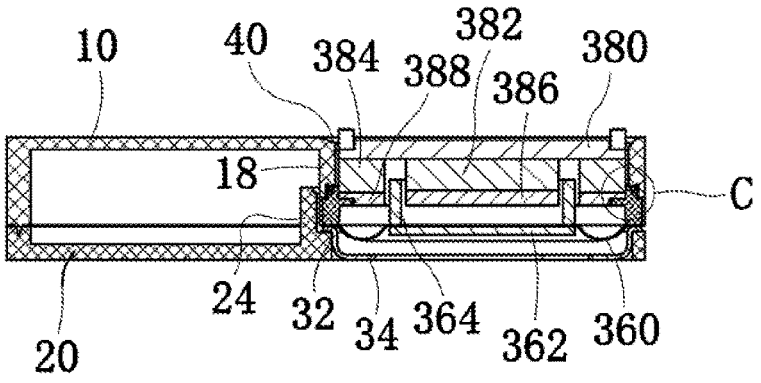
FIG. 4 is a cross-sectional view taken along line B-B in FIG. 3.
Figure 6:
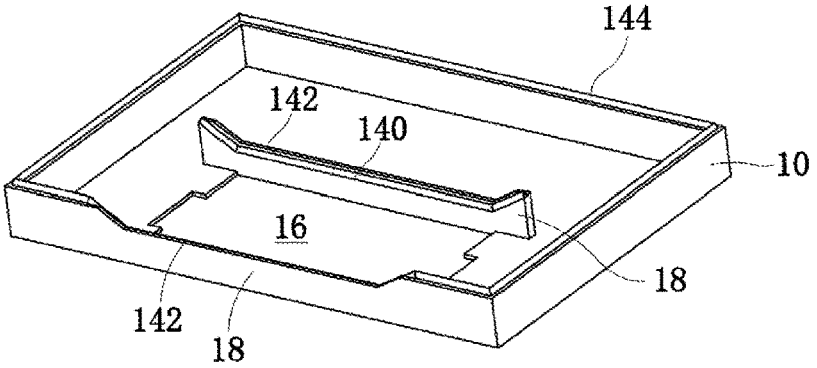
FIG. 6 is a schematic structural view of the lower housing in FIG. 1.
Figure 7:
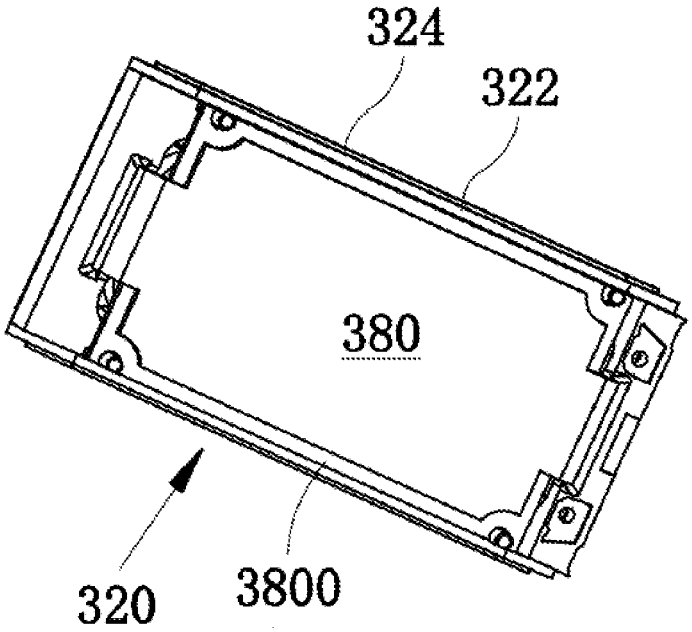
FIG. 7 is a schematic structural view of the loudspeaker unit in FIG. 1.

As shown in FIGS. 4, 6 and 7, the loudspeaker unit 30 comprises a unit housing 32 and a unit front cover 34 combined with each other. A vibration system and a magnetic circuit system are accommodated in a space defined by the unit housing 32 and the unit front cover 34. The lower end surfaces of two sidewalls of the unit housing 32 are provided with ultrasonic surfaces, wherein the two sidewalls are located at two opposite long sides of the unit housing 32. The inner side of the lower housing 10 is provided with ultrasonic lines 140 at the positions corresponding to the ultrasonic surfaces. The loudspeaker unit 30 is fixed to the lower housing 10 through an ultrasonic welding process.

Figure 3:
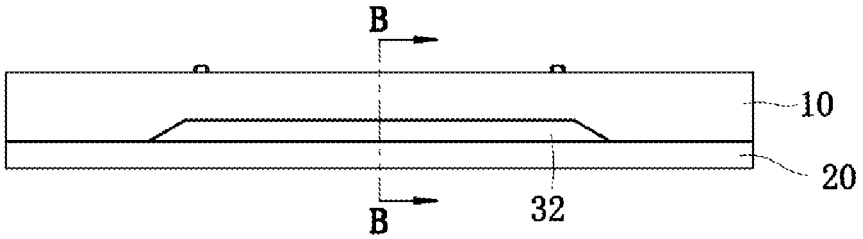
FIG. 3 is a diagram of FIG. 2 viewed from direction A.

As jointly shown in FIG. 2 and FIG. 3, a sidewall of the unit housing 32 located at the long side of the unit housing 32 is exposed to the outside of the module housing, and the sidewall of the unit housing 32 is located between the upper housing 20 and the lower housing 10.

As shown in FIGS. 4, 6 and 7, the lower end surfaces of the two sidewalls of the unit housing 32 located at the long sides of the unit housing 32 are lower than the lower end surface of the magnetic circuit system, that is, the ultrasonic surfaces are lower than the lower end surface of the magnetic circuit system. That is to say, the unit housing 32 only wraps a part of the magnetic circuit system adjacent to the vibration system in the longitudinal direction. The lower housing 10 is provided with blocking walls 18 which are provided at positions corresponding to the two opposite sidewalls of the unit housing 32 located at the long sides, and extend towards the ultrasonic surfaces, and the ultrasonic lines 140 are provided on the end surfaces of the blocking walls 18. Wherein two sides of the blocking wall 18, which is ultrasonically welded to the sidewall of the unit housing 32 exposed to the outside of the module housing, is connected with other portions of the lower housing 10 to form an annular outer sidewall of the lower housing 10, and the ultrasonic line 140 located on this blocking wall 18 and the ultrasonic line 144 located on the end surface of other portions of the outer sidewall of the lower housing 10 form an annular closed ultrasonic band; the ultrasonic line 140 on this blocking wall 18 is combined with the unit housing 32 by ultrasonic welding, and the ultrasonic line 144 located at the other portions is combined with the upper housing 20 by ultrasonic welding. The other blocking wall 18 is located at the middle part of the inner side of the lower housing 10 and is perpendicular to the bottom of the lower housing 10, and preferably, the length of the other blocking wall 18 is the same as the length of the sidewall of the unit housing 32 located at the long side. Because the bonding strength between the lower housing 10 and the unit housing 32 would be decreased if its length is too short, and the extra part of the blocking wall would occupy the space in the rear acoustic cavity of the module and thus the acoustic performance of the module would be decreased if its length is too long.

As jointly shown in FIGS. 3, 6 and 7, the lower end surfaces of the sidewalls of the unit housing 32 located at the two long sides each has an approximately bridge-floor shape, that is, the middle part of each of the end surfaces is a horizontal surface, and both ends of each of the end surfaces are inclined surfaces extending towards the upper end surface of the unit housing 32 (i.e., the upper end surface of the sidewall), and both of the inclined surfaces extend to the upper end surface. The ultrasonic surface also has an approximately bridge-floor shape, that is, the ultrasonic surface extends from an end of one inclined surface along the inclined surface, extends through the horizontal surface, and extends to an end of the other inclined surface. The structure of the end surface of the blocking wall 18 is adapted to the structure of the end surface of the sidewall of the unit housing 32 located at the long side, that is, the end surface of the blocking wall 18 has a concave structure with two higher ends and a lower middle part, so that the part of the unit housing 32 exposed to the outside of the module housing forms an isosceles trapezoidal shape. This structure ensures that side surfaces of the sidewall of the unit housing 32, other than the upper end surface of the sidewall, can be ultrasonically welded to the lower housing 10, thereby further improving the airtightness of the module and simplifying the assembly process.

Figure 5:
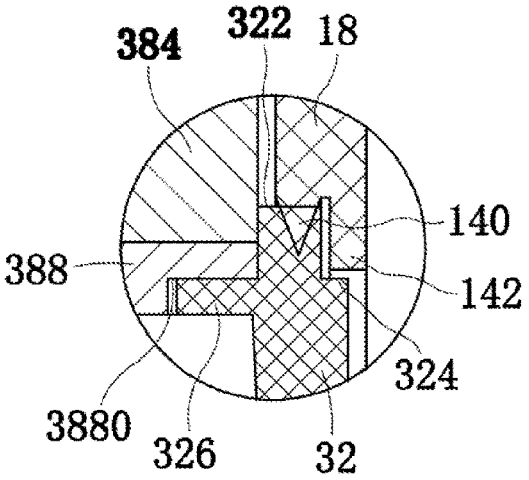
FIG. 5 is an enlarged view of section C of FIG. 4.

As jointly shown in FIGS. 5, 6 and 7, each of the lower end surfaces of the sidewalls of the unit housing 32 located at the two long sides of the unit housing 32 is a stepped end surface 320, which is composed of two stepped surfaces comprising a first stepped surface 322 located at the inner side and a second stepped surface 324 located at the outer side, the position of the first stepped surface 322 is higher than the position of the second stepped surface 324, the first stepped surface 322 is the ultrasonic surface. The end surface of the blocking wall 18 also has a stepped structure, which is also composed of two stepped surfaces with a lower stepped surface at the inner side and a higher stepped surface at the outer side, and the ultrasonic line 140 is located on the lower stepped surface, so that the stepped surface at the outer side forms a boss 142 outside the ultrasonic line 140. The ultrasound line 140 is bonded to the first stepped surface 322 through ultrasonic welding, and the boss 142 abuts against the second stepped surface 324. The end surfaces of the unit housing 32 and the blocking wall 18 which are combined with each other are arranged as stepped structures. When ultrasonic welding is performed, the two stepped structures cooperate with each other to greatly improve the positioning accuracy of the loudspeaker unit, thereby improving the accuracy of the ultrasonic welding position. At the same time, the boss 142 is located outside the ultrasonic line 140 to effectively prevent excessive glue when the ultrasonic welding is performed, which ensures the boundary dimension of the module, and the smoothness of the appearance.

As jointly shown in FIGS. 1 and 4, a first mounting hole 26 is provided on the upper housing 20 at a position corresponding to the loudspeaker unit 30, the unit front cover 34 is located at the first mounting hole 26, and the outer surface of the unit front cover 34 is flush with the outer surface of the upper housing 20. Such a structure is effective in reducing the thickness of the module, so that the module can be adapted to the requirements of thin-type electronic devices.

As jointly shown in FIGS. 1 and 4, a retaining wall 24 surrounding the outer periphery of the first mounting hole 26 is arranged inside the upper housing 20, and the retaining wall 24 only surrounds three sides of the first mounting hole 26 which are not adjacent to the edge of the upper housing 20. The inner surface of the upper housing 20 between the retaining wall 24 and the edge of the first mounting hole 26 is used for gluing so as to be combined with the loudspeaker unit 30. A portion for gluing is arranged between the edge of the side of the first mounting hole 26 adjacent to the edge of the upper housing 20 and the edge of the upper housing 20, thereby forming a closed gluing band 22 around the first mounting hole 26. The unit front cover 34 comprises a protruded portion located at the central portion, and the periphery of the protruded portion is provided with a planar edge. The protruded portion is located at the first mounting hole 26, and the planar edge is overlapped with the gluing band 22 and is fixed to the upper housing 20 by means of sealant, so as to form an effective seal between the front acoustic cavity and rear acoustic cavity of the module.

As shown in FIGS. 4 and 7, the vibration system comprises a vibrating diaphragm 360 having an edge portion fixed between the unit housing 32 and the unit front cover 34. A dome 362 is fixed to the middle part of one side of the vibrating diaphragm 360 adjacent to the unit front cover 34, and a voice coil 364 is fixed to the other side of the vibrating diaphragm 360. The magnetic circuit system comprises a yoke 380. The yoke 380 comprises a rectangular bottom. A yoke sidewall perpendicular to the bottom is arranged at each of the edges of two short sides of the bottom. An inner magnet 382 and an inner washer 386 are successively fixed to the middle part of the inner side of the bottom of the yoke 380. Edge magnets 384 and edge washers 388 are successively fixed to edge portions of two long sides of the inner side of the bottom, respectively. The inner magnet 382 and inner washer 386 constitute the inner magnetic circuit of the magnetic circuit system, and the yoke sidewalls and the edge magnets 384 and the edge washers 388 constitute the outer magnetic circuit of the magnetic circuit system. A magnetic gap is formed between the inner magnetic circuit and the outer magnetic circuit, and the end portion of the voice coil 364 is located in the magnetic gap. The voice coil 364 moves in such a way that the voice coil 364 cuts magnetic induction lines repeatedly in the magnetic gap according to the magnitudes and polarities of the electric signals of acoustic waves transmitting through the windings of the voice coil, and then the vibrating diaphragm 360 and the dome 362 vibrate along with the movement of the voice coil 364 to stir up air so as to generate sound, thereby transforming energy between electricity and sound. The middle part of the unit front cover 34 is provided with a sound hole, and the sound generated by the vibrating diaphragm 360 and the dome 362 is output through the sound hole.

As jointly shown in FIGS. 1, 4, and 6, a second mounting hole 16 is provided on the lower housing 10 at a position corresponding to the loudspeaker unit 30, and the shape of the second mounting hole 16 is adapted to the shape of the bottom of the yoke 380. The two blocking walls 18 are located at the edges of two long sides of the second mounting hole 16, and clamp the magnetic circuit system together with the two sidewalls of the unit housing 32. The bottom of the yoke 380 (i.e., the lower end of the magnetic circuit system) is located at the second mounting hole 16, and the outer surface of the bottom of the yoke 380 is flush with the outer surface of the lower housing 10. With such a configuration, the entire thickness of the module may be further reduced to enable the module to meet the requirement of thin-type electronic equipments.

As jointly shown in FIGS. 2, 4 and 7, a chamfering slope 12 is provided on the outer surface of the lower housing 10 and is located at the periphery of the second mounting hole 16 (see FIG. 6). A recessed edge portion 3800 is provided at the edge of the outer surface of the bottom of the yoke 380, and a glue accommodating groove 40 is formed between the chamfering slope 12 and the edge portion 3800. With such a structure, the contact area between the sealant and the lower housing 10 along with the yoke 380 is increased, and the firmness of adhesion and the airtightness of the rear acoustic cavity are effectively improved.

As jointly shown in FIGS. 4 and 5, positioning protrusions 326 extending towards the edge washers 388 are provided on the inner sides of the sidewalls of the unit housing 34 at the two long sides and are provided at positions corresponding to the two edge washers 388, and positioning recesses 3880 adapted to the positioning protrusions 326 are provided on the edge washers 388 at positions corresponding to the positioning protrusions 326. The positioning protrusions 326 are combined with the positioning recesses 3880. With this structure, the contact area between the unit housing 32 and the magnetic circuit system is increased, and the firmness of combination between the unit housing 32 and the magnetic circuit system can be improved effectively.

The above-described embodiments have been described in detail by taking the technical solution that the sidewalls of the unit housing located at the two long sides of the unit housing are combined with the lower housing by ultrasonic welding as an example, but the present invention is not limited to the above technical solution. In practice, the ultrasonic welding structure can be provided only on one sidewall of the unit housing according to the structure of the module, or the ultrasonic structures may be provided on three or four sidewalls of the unit housing. Compared to a configuration that the ultrasonic structure is provided on only one sidewall, the present technical solution that the ultrasonic structures are provided on two opposite sidewalls is effective to avoid phenomena, such as, bend or deformation of the vibrating diaphragm due to uneven stress applied to the loudspeaker unit during ultrasonic welding, and cracking of the sealant in the front cavity. Compared to a configuration that ultrasonic structures are provided on three or four sidewalls, the present technical solution has the advantageous effects that the structures of the lower housing and the unit housing are simpler, and the space in the rear cavity of the module is saved and the acoustic performance of the module is ensured. Thus, it is a preferred technical solution of the present invention that the ultrasonic structures are provided on the two opposite sidewalls of the unit housing to be combined with the lower housing by ultrasonic welding.

In the present invention, the ultrasonic welding structure is provided between the lower end surface of the unit housing and the module housing so as to bond the loudspeaker unit to the module housing by ultrasonic welding, which effectively simplifies the assembly process of the loudspeaker module. At the same time, the acoustic performance of the loudspeaker module is improved, thereby prolonging the service life of the loudspeaker module. In particular, the assembly process of the loudspeaker module with exposed loudspeaker unit is simplified, thereby improving the airtightness between the module housing and the loudspeaker unit, improving the appearance quality of the module, and reducing the production cost.

As shown in FIG. 1, the assembly process of the loudspeaker module of the present invention is as follows:

in the first step, sealant is applied to the gluing band 22, and then the loudspeaker unit 30 is fixed to the upper housing 20 to seal the front acoustic cavity, and an enclosed ultrasonic band is formed by the edge of the upper housing 20 combined with the loudspeaker unit 30 and the ultrasonic surface of the unit housing 32;

in the second step, the lower housing 10 is arranged on the upper housing 20, and then the lower housing 10 and the upper housing 20 are hermetically combined with each other through an ultrasonic welding process so as to seal the rear acoustic cavity.

As shown in FIG. 2, if the yoke is exposed to the outside, glue is applied between the yoke 380 and the lower housing 10 after the second step, so as to complete sealing of the rear acoustic cavity.

The above embodiments of the present invention are merely illustrative examples of the technical solution of the present invention that the loudspeaker unit and the module housing are combined by an ultrasonic welding process, in which the overall structure of the module and the structure of the loudspeaker unit are not limited to the above structures. Thus, the technical solution of the present invention can be applied to any of the modules with exposed loudspeaker units. Those skilled in the art will be able to apply the technical solution of the present invention to modules with other construction without requiring any creative work according to the description of the above embodiments. Therefore, it falls into the protection scope of the present invention to simplify the assembly process, improve the airtightness and appearance quality of the module and reduce production cost by providing products with the loudspeaker unit combined with the module housing through an ultrasonic welding process, regardless of whether the overall structure of the loudspeaker module is the same as that of the above embodiments, and whether the structure of the loudspeaker unit is the same as that of the above embodiments.

The feature names (such as the first stepped surface and the second stepped surface) with the serial number related in this specification are only used for distinguishing the technical features, and do not represent the positional relationship, assembly sequence, and operation sequence of the features.

The present invention is not limited by the above specific embodiments, and various variations made by those skilled in the art according to the above conceptions without creative labor fall into the protection scope of the present invention.

The invention claimed is:

1. A loudspeaker module, comprising: a module housing, wherein a loudspeaker unit is accommodated in the module housing, the loudspeaker unit comprises a unit housing and a unit front cover combined with each other, and a vibration system and a magnetic circuit system are accommodated in a space defined by the unit housing and the unit front cover, wherein an end surface of at least one sidewall of the unit housing is provided with an ultrasonic surface ultrasonically welded with the module housing, and the module housing is provided with an ultrasonic line which is provided at a position corresponding to the ultrasonic surface and is combined with the ultrasonic surface by ultrasonic welding, and wherein the loudspeaker unit is disposed adjacent to an edge of one side of the module housing, a sidewall of the unit housing is exposed to the outside of the module housing, and the ultrasonic surface is provided on the sidewall of the unit housing exposed to the outside of the module housing.

2. The loudspeaker module according to claim 1, wherein another sidewall of the unit housing, which is disposed corresponding to the sidewall exposed to the outside of the module housing, is also provided with the ultrasonic surface.

3. The loudspeaker module according to claim 1, wherein the ultrasonic surface is lower than a corresponding end surface of the magnetic circuit system, the module housing is provided with a blocking wall which is provided at a position corresponding to the ultrasonic surface and extends towards the ultrasonic surface, and the ultrasonic line is provided on an end surface of the blocking wall.

4. The loudspeaker module according to claim 3, wherein a middle portion of the ultrasonic surface is a flat surface, and both ends of the ultrasonic surface are inclined surfaces extending towards an upper end surface of the unit housing and extending to the upper end surface, and a structure of the end surface of the blocking wall is adapted to a structure of the ultrasonic surface.

5. The loudspeaker module according to claim 4, wherein the end surface of the sidewall of the unit housing provided with the ultrasonic surface is a stepped end surface comprising a first stepped surface located at an inner side and a second stepped surface located at an outer side, a position of the first stepped surface is higher than a position of the second stepped surface, and the first stepped surface is the ultrasonic surface; and the end surface of the blocking wall has a stepped structure adapted to the stepped end surface, and the ultrasonic line is provided on a stepped surface of the stepped structure corresponding to the first stepped surface.

6. The loudspeaker module according to claim 5, wherein the module housing comprises an upper housing and a lower housing combined with each other, the sidewall of the unit housing exposed to the outside of the module housing is located between the upper housing and the lower housing, and the blocking wall is provided on the lower housing.

7. The loudspeaker module according to claim 6, wherein the upper housing is provided with a first mounting hole at a position corresponding to the loudspeaker unit, the unit front cover is located at the first mounting hole, and an outer surface of the unit front cover is flush with an outer surface of the upper housing; a retaining wall surrounding an outer side of the first mounting hole is provided at an inner side of the upper housing, and an inner surface of the upper housing is formed with a gluing band between the retaining wall and an edge of the first mounting hole.

8. The loudspeaker module according to claim 7, wherein the lower housing is provided with a second mounting hole at a position corresponding to the loudspeaker unit, a lower end of the magnetic circuit system is located at the second mounting hole, a lower end surface of the magnetic circuit system is flush with an outer surface of the lower housing; and the outer surface of the lower housing is provided with a chamfering slope located at a periphery of the second mounting hole, the lower end surface of the magnetic circuit system is provided with a recessed edge portion, and a glue accommodating groove is formed between the chamfering slope and the edge portion.

9. The loudspeaker module according to claim 8, wherein the magnetic circuit system comprises a yoke, and an inner magnet and an inner washer fixed to a middle portion of an inner side of the yoke successively, edge magnets and edge washers are successively fixed to edge portions of two sides of the yoke parallel to the ultrasonic surface, inner sides of two sidewalls of the unit housing, which are located at the same sides as two said edge washers, are provided with positioning protrusions which are provided at positions corresponding to the edge washers and extend towards the edge washers, and the edge washers are provided with positioning recesses which are provided at positions corresponding to the positioning protrusions and are adapted to the positioning protrusions.

* * * * *